United States Patent [19]

Towns et al.

[11] Patent Number: 4,558,794

[45] Date of Patent: Dec. 17, 1985

[54] CONTAINER WITH VESSEL FOR RETENTION OF TELLTALES

[75] Inventors: Edward J. Towns, Morristown; Edward M. Brown, Livingston, both of N.J.

[73] Assignee: TBL Development Corporation, Livingston, N.J.

[21] Appl. No.: 542,191

[22] Filed: Oct. 19, 1983

[51] Int. Cl.[4] ..... B65D 55/02

[52] U.S. Cl. ..... 215/250; 215/203; 215/230; 215/347; 215/348; 215/350; 215/366; 215/DIG. 1; 220/377; 220/378

[58] Field of Search ..... 215/203, 209, 211, 213, 215/214, 230, 250–253, 257, 258, 341, 343, 344, 347, 349–351, 329, 232, 348, 366, 31, 330, 219, 220, 247, DIG. 1; 220/378, 377

[56] References Cited

U.S. PATENT DOCUMENTS

| | | | |
|---|---|---|---|
| 603,151 | 4/1898 | Norton . | |
| 939,602 | 11/1909 | Landon . | |
| 1,095,313 | 5/1914 | Davids . | |
| 2,068,389 | 1/1937 | Smith | 215/350 |
| 2,090,555 | 8/1937 | Sharp . | |
| 2,131,774 | 10/1938 | Waring | 215/250 |
| 2,131,775 | 10/1938 | Waring | 215/250 |
| 3,489,307 | 1/1970 | Wenger | 215/351 X |
| 3,501,042 | 3/1970 | Risch et al. | 215/232 |
| 3,819,460 | 6/1974 | Dukess . | |
| 3,826,221 | 7/1974 | Ross . | |
| 3,899,295 | 8/1975 | Halpern . | |
| 3,917,100 | 11/1975 | Dukess . | |
| 3,923,198 | 12/1975 | Brochman . | |

*Primary Examiner*—Allan N. Shoap
*Assistant Examiner*—Bryon Gehman
*Attorney, Agent, or Firm*—Robin, Blecker & Daley

[57] ABSTRACT

A vessel for use with a closure member of type having a telltale therein for tamper indication and movable in first and second opposite senses relative to said vessel for joinder and removal. The vessel comprises the customary neck terminating in a vessel mouth and defining surface extent circumscribing the mouth and inclusive of vessel sealing surface and the neck has the typical threads for closure member securing thereon. In accordance with the invention, the vessel surface extent is adapted for engaging the telltale and is configured to effect first and second different engagements therewith respectively in the course of the first and second sense movements. With such facility, the vessel permits the telltale to be moved into closure relation with the sealing surface and to be selectively positively restrained from movement relative to the mouth in the initial phase of the second closure member movement.

18 Claims, 7 Drawing Figures

CONTAINER WITH VESSEL FOR RETENTION OF TELLTALES

FIELD OF THE INVENTION

This invention relates generally to article containers and pertains more particularly to vessels for use with container closure members having telltales providing tamper indication.

BACKGROUND OF THE INVENTION

In a series of United States patent applications, copending and assigned in common herewith, a temper-indicative system and various components thereof are set forth. In applications Ser. No. 441,109 filed on Nov. 12, 1982 and Ser. No. 443,608 filed on Nov. 22, 1982, applicants provide a container having a jar with a mouth for access to its contents, a telltale element and a see-through cap releasably securable to the jar and circumscribing its mouth and the telltale element when secured to the jar. The cap includes one or more puncturing elements interiorly of the cap for travel with the cap. The telltale element is arranged in captive relation to the puncturing element prior to assembly of the cap with the jar. As the cap is rotated into securement with the jar, the telltale element becomes secured to the jar mouth as it engages same, for example, through contact activation of a sealant on the jar mouth or heat flowing of telltale plastic onto the jar mouth. Reverse sense opening movement of the cap is accompanied by visible rupturing and tearing of the telltale.

The puncturing element may take the form of one or more knife-like tines depending from the cap upper interior surface and non-deflectable relative thereto. The cap is desirably made of transparent material such that the condition of the telltale element may be viewed constantly after the initial assembly juncture and to the point of consumer sale.

In U.S. patent application Ser. No. 450,531 filed on Dec. 17, 1982, also copending and assigned in common herewith, a telltale is set forth for use in the described system which has a compressible layer, such as foam, in which the tines are captive. The telltale is preferably a laminate inclusive of such compressible layer and an underlayer which is both effective to blunt the tines in fully captured relation in the compressible layer and to serve as a jar sealing layer. A foil overlayer may also be included. The cap may include means for distributing force applied to the telltale to its periphery, thereby lessening the likelihood of tine rupture of the telltale movement of the cap into initial securement with a jar.

Underlying the system as described is a need to anchor the telltale to the container following movement of the closure member and telltale to initially close the container at the point of manufacture. In the above noted embodiments, use is made of a contact-activated adhesive or the telltale underlayer plastic is heat-flowed onto the container forming a bond between the telltale and the container. In those instances of user preference not to have any such bond, the subject tamper-indicating system as described heretofore is not applicable.

U.S. Pat. Nos. 2,131,774 and 2,131,775—Waring, disclose tamper-indicating containers of type including a tamper-indicating element located at the container mouth opening and activated upon closure member opening movement, without the presence of an adhesive at the telltale insert and container interface.

The Waring '774 practice is to provide a cap in the form of a hollow cylinder having a skirt depending from the cap top and interiorly threaded to receive the jar neck. The cap top is centrally open and prongs are formed in the plane of the cap extending into the central opening. The telltale element is nested in the cap interior and suitably secured therein. The cap with its nested telltale is then rotated into secured relation with the jar. Now the prongs are bent out of the plane of the cap top and into puncturing relation with the telltale element, remaining accessible through the open cap top. Waring relies on the friction existing between the planar surfaces of the telltale insert and the container to hold the telltale insert relative to the cap, such that the cap tines can effect tampering or indicate initial container opening.

In practice under the Waring '775 patent, the telltale is secured to the cap for movement therewith, the cap again having its top centrally open. A liner is stapled, stitched or glued to the telltale. In the course of rotation of the cap, telltale and liner into secured relation with a jar, a frictional planar undersurface of the liner is compressed onto the planar jar neck surface by friction therebetween. As the cap is rotated in opposite sense to be released from the jar, the cap and telltale are said to rotate initially relative to the liner and staple, whereby the staple ruptures the telltale.

In applicant's view, reliance upon simple frictional engagement as between the planar surfaces of the telltale insert and the container mouth detracts in substance from the integrity of a tamper-indicating system. Furthermore, the achievement of even simple frictional surface engagement in the Waring systems is attained only by complicated telltale insert structures, and does not lend itself to ready adaptation to conventional caps in present commercial use.

SUMMARY OF THE INVENTION

This invention has as its primary object the adaptation of the described and commonly-assigned tamper-indicative system to applications precluding adhesive or other bonded relation of teltales and vessels.

The invention has as a more specific object the provision of vessels adapted structurally to permit such adaptation of the described tamper-indicative system.

In attaining these and other objects, the invention provides a vessel for use with a closure member of type having a telltale therein for tamper indication and movable in first and second opposite senses relative to said vessel for joinder and removal. The vessel comprises the customary neck terminating in a vessel mouth and defining surface extent circumscribing the mouth and inclusive of vessel sealing surface and the neck has the typical threads for closure member securing thereon. In accordance with the invention, the vessel surface extent is adapted for engaging the telltale and is configured to effect first and second different engagements therewith respectively in the course of the first and second sense movements. With such facility, the vessel permits the telltale to be moved into closure relation with the sealing surface in first sense closure movement and to be selectively positively restrained from movement relative to the mouth in the initial phase of the second sense closure member movement.

In its particularly preferred embodiment, the vessel surface extent includes teeth outwardly of the sealing surface for effecting such selective positive restraint of movement of the telltale means. Viewing the vessel an upstanding member, a plurality of individual teeth are provided, each tooth having a root disposed below the sealing surface and a peak disposed above the sealing surface. The sealing surface is a horizontal annulus and each tooth has a clockwise lagging side inclined to the horizontal and a clockwise leading side extending substantially vertically, the two sides intersecting at the tooth peak. The vessel surface extent desirably further includes a second horizontal annulus extending below the sealing surface and between the teeth and the sealing surface.

The foregoing and other objects and features of the invention will be further evident from the following detailed description thereof and from the drawings wherein like reference numerals identify like parts throughout.

DESCRIPTION OF THE PREFERRED EMBODIMENTS

Figure 1:
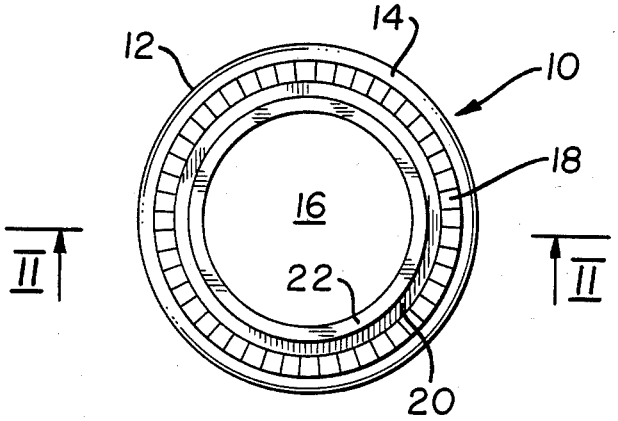
FIG. 1 is a top plan view of a vessel in accordance with the invention.
Figure 2:
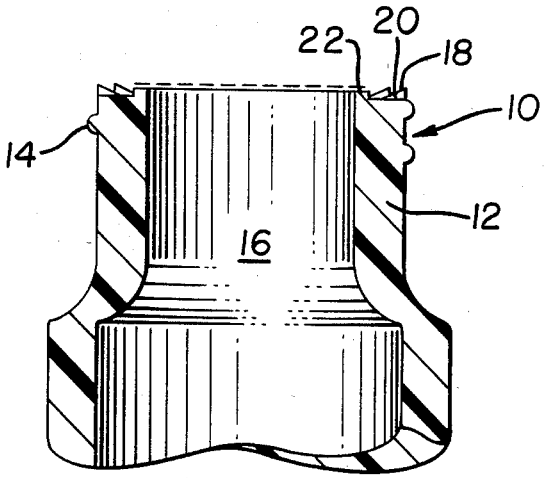
FIG. 2 is a sectional view of the FIG. 1 vessel as would be seen from plane II—II of FIG. 1.
Figure 3:
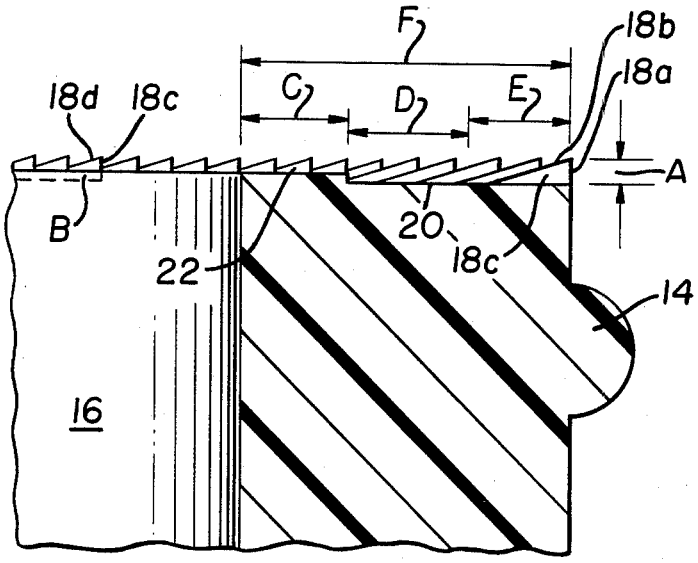
FIG. 3 is an enlarged partial view of the FIG. 2 vessel showing.

Referring to FIGS. 1 through 3, vessel 10 is comprised of glass or suitable plastic of type resistant to needle penetration and includes a neck 12 bearing suitable cap securement threads 14 on its exterior surface and providing an access channel between the vessel mouth and vessel interior compartment 16. The vessel defines surface extent circumscribing the mouth, inclusive of peripheral teeth 18, a flat expanse 20 and vessel sealing surface 22.

As is indicated in the enlarged showing of FIG. 3, which depicts the upper right corner portion of FIG. 2, sealing surface 22 directly borders the mouth and is a flat annulus (FIG. 1). Flat expanse 20 is also an annulus, contiguous with sealing surface 22 and vertically recessed therebelow by dimension B. Expanse 20 extends to the root, i.e., the lower end of inclined surface **18*b*, of teeth 18. Each of teeth 18 also has an outer vertical side 18*a*, leading to a tooth peak, an interior side 18*c* which is substantially vertically disposed and another interior side 18*d*, which is inclined to the horizontal. In clockwise sense in FIG. 1, side 18*c* is clockwise leading and side 18*d* is clockwise lagging, sides 18*c* and 18*d* of each tooth intersecting at such tooth peak and otherwise throughout the length of inclined surface 18*b*. Teeth 18 will be seen to rise vertically above sealing surface 22 by a dimension equal to the difference between A and B and accordingly the teeth can penetrate a layer applied to surface extent 18-20-22 to the depth therein equal to such difference dimension when the layer is in sealed relation with sealing surface extent 22. The full radial dimension of surface extent 18-20-22 is noted as F, equal subdimensions C, D and E applying to the radial dimension of sealing surface 22, recessed expanse 20 and teeth 18**.

Figure 4:
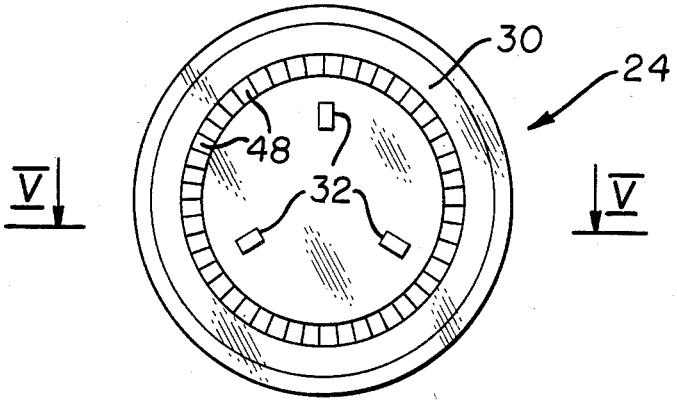
FIG. 4 is a top plan view of a closure member for use with the FIG. 1 vessel in providing a tamper-indicative container.
Figure 5:
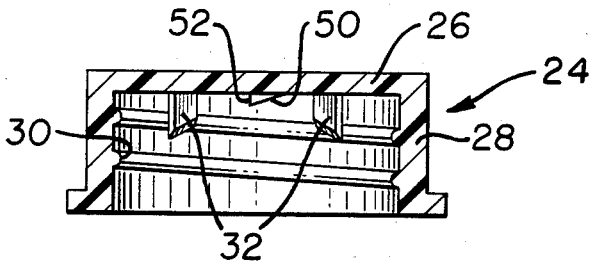
FIG. 5 is a sectional view of the FIG. 4 closure member as would be seen from plane V—V of FIG. 4.

Referring to FIGS. 4 and 5, a closure member or cap 24 is comprised of transparent or translucent plastic of type impenetrable to needles and the like and includes a top panel 26 with depending skirt 28 and threads 30 cooperative with container threads 14 for movement of the closure member in a first sense (clockwise) for securement to neck 12 and for closure of the mouth and in second opposite sense (counterclockwise) for removal of the closure member from the neck. Depending from the top panel is at least one retaining-tearing member 32 for engagement with a telltale. Each retaining-tearing member is radially offset from the rotation center of such first and second movements of the closure member and has a knife-like or tine configuration. Three such tines are illustrated, angularly equally spaced from one another. The closure member is a typically a hollow cylinder having an open end, the retaining-tearing members extending generally parallel to the axis of said cylinder and formed integrally therewith.

Figure 6:
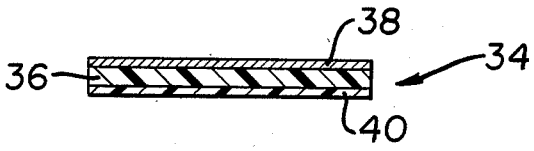
FIG. 6 is a sectional view of a telltale assembly for use an insert to the closure member of FIGS. 4 and 5.

In FIG. 6 is shown a preferred teltale 34 for use in practice and described more in detail and in other embodiments in the '531 patent application referred to above. Telltale 34 includes a compressible inner layer 36, of open cell foam, an upper layer 38 of metal foil and a lower layer 40 of closed cell foam, suitable for sealing the vessel to which it is applied. As is discussed in detail in the '531 application, cap 24 is inverted from its FIG. 5 disposition and telltale 34 is forced therein by a punch to embed tines 32 in compressible layer 36, the tines being so deformed therein as to mechanically retain the telltale in the cap with sealing layer 40 maintained intact to subsequently effect its jar sealing function.

Figure 7:
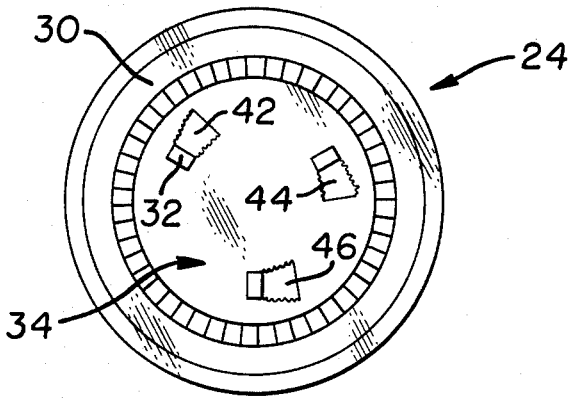
FIG. 7 is a top plan view of typical tamper indication provided upon opening a container employing the vessel, the closure member and telltale assembly shown in FIGS. 1 through 6.

As cap 24, with assembled telltale 34, is threaded onto vessel 10 at the point of initial closing of the container after content filling thereof, layer 40 rides relatively freely over ramp-like surfaces **18*d* of vessel 10 and ultimately, closure between cap 24 and vessel 10 is such that layer 40 abuts sealing surface 22 to effect sealing of the vessel. At this juncture, based on the increased height of teeth 18 above surface 22, and the vertical sides 18*c* of the teeth, the teeth take up residence in layer 40 in such manner that telltale 34 will be positively restrained from movement relative to vessel 10 in the initial course of opening movement (counterclockwise) of cap 24. There results consequently the required relative movement of tines 32 with respect to telltale 34 and visible rupturing thereof, as indicated typically in FIG. 7 at torn telltale areas 42, 44 and 46. The foam is torn through, exposing any desired tamper indicia placed on the upper surface of layer 40**.

Referring again to FIGS. 4 and 5, cap 24 is shown as having teeth 48 situated at the inner periphery of top panel 26 for engagement with the telltale. These teeth 48, only one of which is shown for convenience in FIG. 5, function to distribute the force applied to the cap in initial closure of a container over the periphery of the telltale, and permit the use of delicate telltale upper layers without damage thereto during such initial closure. Teeth 48 have a root disposed at the top panel and a peak disposed therebelow. Contrary to the sense of the teeth 18 of vessel 10, the closure member teeth 48 have a clockwise lagging side 50 inclined to the horizontal and a clockwise leading side 52 extending substantially vertically, the sides intersecting at the tooth peak. Accordingly, in cap closing movement, the teeth engage the telltale at their vertical sides and, in cap opening sense movement, the teeth ride freely upon the telltale and limit telltale tamper indication to the tine-telltale engagement locations. By the tern "clockwise leading" is meant that same is spatially ahead in a clockwise direction, as one o'clock is clockwise leading twelve o'clock. Conversely twelve o'clock is clockwise lagging one o'clock.

Various changes to structure and modifications to practice may be introduced to the foregoing embodiments without departing from the invention. By way of example, the peaks of teeth 18 of vessel 10 could be radially outward of the roots thereof and at the same vertical elevation as the roots to effect like different engagement between the vessel and the teltale in respective different sense movements of the closure member. The preferred embodiments as are particularly depicted and discussed are accordingly intended in an illustrative and not in a limiting sense. The true spirit and scope of the invention is set forth thus in the following claims.

We claim:

1. A container comprising:

(a) a vessel having a neck terminating in a vessel mouth and defining surface extent circumscribing said mouth and inclusive of vessel sealing surface, said neck having closure member securing means thereon;

(b) a see-through closure member having interior means cooperative with said securing means for movement of said closure member in a first sense for securement to said neck and for closure of said mouth and in second opposite sense for removal of said closure member from said neck; and (c) telltale means secured to said closure member for activation thereby in the course said closure member second sense movement to provide tamper indication; said vessel surface extent being adapted for engaging said telltale means and having respective first and second different surface configurations to effect first and second different engagements therewith respectively in the course of said first and second sense movements, thereby to permit said telltale means to be moved into closure relation with said sealing surface and to be selectively positively restrained from movement relative to said mouth in at least the initial phase of said second sense closure member movement.

2. The container claimed in claim 1 wherein said vessel surface extent includes tooth means outwardly of said sealing surface for effecting such selective positive restraint of movement of said telltale means.

3. The container claimed in claim 2 wherein said vessel is an upstanding member, said tooth means having a plurality of individual teeth, each tooth having a root disposed below said sealing surface and a peak disposed above said sealing surface.

4. The container claimed in claim 3 wherein said sealing surface is a horizontal annulus, each said tooth having a clockwise leading side inclined to the horizontal and a clockwise lagging side extending substantially vertically, said first and second sides intersecting at said tooth peak.

5. The container claimed in claim 4 wherein said vessel surface extent further includes a second horizontal annulus extending below said sealing surface and between said teeth and said sealing surface.

6. The container claimed in claim 1 wherein said closure member comprises at least one retaining-tearing member extending from said closure member into engagement with said telltale means.

7. The container claimed in claim 6 wherein said closure member is adapted for rotative first and second movements of respectively opposite sense and wherein said retaining-tearing member is radially offset from the rotation center of such first and second movements.

8. The container claimed in claim 7 wherein said retaining-tearing member is integral with said closure member.

9. The container claimed in claim 7 wherein said closure member is a hollow cylinder having an open end, said retaining-tearing member extending generally parallel to the axis of said cylinder and radially offset therefrom.

10. The container claimed in claim 6 wherein said telltale means comprises a compressible layer and a sealing layer secured to one side of said compressible layer and intervening said vessel surface extent and said compressible layer.

11. The container claimed in claim 6 wherein said closure member includes tooth means for engagement with said telltale means at the periphery thereof.

12. The container claimed in claim 11 wherein said closure member is an upstanding member including a top panel, said tooth means extending downwardly from said top panel and comprising a plurality of individual teeth, each tooth having a root disposed at said top panel and a peak disposed therebelow.

13. The container claimed in claim 12 wherein each said tooth has a clockwise lagging side inclined to the horizontal and a clockwise leading side extending substantially vertically, said first and second sides intersecting at said tooth peak.

14. A vessel for use with a see-through closure member therefor having a telltale therein for tamper indication and movable in first and second opposite senses relative to said vessel for joinder therewith and removal therefrom, said vessel comprising a neck terminating in a vessel mouth and defining surface extent circumscribing said mouth and inclusive of vessel sealing surface, said neck having closure member securing means thereon; said vessel surface extent being adapted for engaging said telltale and having respective first and second different surface configurations to effect first and second different engagements therewith respectively in the course of said first and second sense movements, thereby to permit said telltale means to be moved into closure relation with said sealing surface and to be selectively positively restrained from movement relative to said mouth in at least the initial phase of said second sense closure member movement.

15. The vessel claimed in claim 14 wherein said vessel surface extent includes tooth means outwardly of said sealing surface for effecting such selective positive restraint of movement of said telltale means.

16. The container claimed in claim 15 wherein said vessel is an upstanding member, said tooth means having a plurality of individual teeth, each tooth having a root disposed below said sealing surface and a peak disposed above said sealing surface.

17. The container claimed in claim 16 wherein said sealing surface is a horizontal annulus, each said tooth having a clockwise lagging side inclined to the horizontal and a clockwise leading side extending substantially vertically, said first and second sides intersecting at said tooth peak.

18. The container claimed in claim 17 wherein said vessel surface extent further includes a second horizontal annulus extending below said sealing surface and between said teeth and said sealing surface.

* * * * *